US006896156B2

(12) United States Patent
McDonald et al.

(10) Patent No.: US 6,896,156 B2
(45) Date of Patent: May 24, 2005

(54) PLASTIC PAINT CONTAINER HAVING A CUBE-SHAPED BODY

(75) Inventors: Robert E. McDonald, Strongsville, OH (US); Paul R. Katterle, Chesterland, OH (US); John F. Kramer, University Heights, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 10/612,570

(22) Filed: Jul. 2, 2003

(65) Prior Publication Data

US 2004/0011831 A1 Jan. 22, 2004

Related U.S. Application Data

(60) Provisional application No. 60/394,095, filed on Jul. 3, 2002.

(51) Int. Cl.[7] ..... B67D 1/16

(52) U.S. Cl. ..... 222/109; 222/143; 222/466; 222/567

(58) Field of Search ..... 222/109, 143, 222/466, 566, 567, 568, 569, 570, 571, 572, 573

(56) References Cited

U.S. PATENT DOCUMENTS

| | | | | |
|---|---|---|---|---|
| D34,895 | S | 8/1901 | McFaddin | |
| 2,194,486 | A | 3/1940 | Straub | 215/44 |
| 2,324,338 | A | 7/1943 | Tripp | 221/11 |
| 2,659,519 | A | 11/1953 | Allen | 222/567 |
| 2,707,574 | A | 5/1955 | Klebenow | 215/13 |
| 2,743,844 | A | 5/1956 | Livingstone | 222/11 |
| 2,763,402 | A | 9/1956 | Livingstone | 222/109 |
| 2,817,465 | A | 12/1957 | Gray | 222/570 |
| 2,851,196 | A | 9/1958 | Livingstone | 222/111 |
| 3,000,527 | A | 9/1961 | Jennings et al. | 215/100 |
| D192,886 | S | 5/1962 | Kaplan | D58/5 |
| D206,407 | S | 12/1966 | Sharp | D58/5 |
| 3,310,088 | A | 3/1967 | Hildebrandt et al. | 150/0.5 |
| D207,466 | S | 4/1967 | Phillips | D58/17 |
| 3,313,438 | A | 4/1967 | Piker | 215/13 |
| 3,387,749 | A | 6/1968 | Godshalk et al. | 222/143 |
| D211,928 | S | 8/1968 | Burnett | D9/44 |
| D217,231 | S | 4/1970 | Pashman | D9/239 |
| D221,515 | S | 8/1971 | Betka | D9/40 |
| 3,612,595 | A | 10/1971 | Updegraff et al. | 294/31.2 |
| 3,620,410 | A | 11/1971 | Griese, Jr. | 220/94 R |
| 3,625,386 | A | 12/1971 | Schaefer | 215/9 |
| 3,659,758 | A | 5/1972 | Waterman | 222/561 |
| 3,695,488 | A | 10/1972 | Olsson | 222/570 |
| 3,727,792 | A | 4/1973 | Levin | 220/90 |
| 3,744,671 | A | 7/1973 | Saunders, Jr. | 220/90 |
| 3,807,679 | A | 4/1974 | Burke et al. | 248/359 |
| 3,899,107 | A | 8/1975 | Gaal | 222/570 |
| 3,945,527 | A | 3/1976 | Pylant | 220/90 |
| 4,014,465 | A | 3/1977 | Ritter | 222/563 |
| 4,022,352 | A | 5/1977 | Pehr | 222/153 |
| 4,061,242 | A | 12/1977 | Donlon | 220/90 |
| 4,078,700 | A | 3/1978 | Hidding | 222/109 |
| 4,128,189 | A | 12/1978 | Baxter | 222/109 |
| D250,806 | S | 1/1979 | Gutkowski | D9/39 |
| 4,150,763 | A | 4/1979 | Simpson | 220/90 |

(Continued)

FOREIGN PATENT DOCUMENTS

EP 1 243 443 A1 9/2002

OTHER PUBLICATIONS

Copyright 1990 The Financial Times Limited Financial Times (London)—Jan. 4, 1990—3 pages.
Copyright 1994 Information Access Company, a Thomson Corporation Company—Oct. 13, 1994.

*Primary Examiner*—Joseph A. Kaufman
(74) *Attorney, Agent, or Firm*—Arthi K. Tirey; Paul R. Katterle; Robert E. McDonald

(57) ABSTRACT

A square paint container having recesses formed therein for facilitating the pouring of paint from the container.

24 Claims, 7 Drawing Sheets

U.S. PATENT DOCUMENTS 4,203,537 A 5/1980 McAlister ..... 222/570
4,225,064 A 9/1980 Westcott ..... 222/569
4,240,568 A 12/1980 Pool ..... 222/189
4,245,753 A 1/1981 Ellis ..... 220/288
D258,563 S 3/1981 Romagnoli ..... D9/376
D261,362 S 10/1981 Epperson ..... D9/376
4,312,459 A 1/1982 Leach ..... 220/256
4,387,828 A 6/1983 Yates, Jr. ..... 220/284
4,387,922 A 6/1983 Geisinger ..... 294/31.2
D269,948 S 8/1983 Janssen ..... D9/375
4,399,926 A 8/1983 Eidels-Dubovoy ..... 220/288
4,453,647 A 6/1984 Neat ..... 220/288
4,457,458 A 7/1984 Heinol ..... 222/498
4,458,819 A 7/1984 Geiger ..... 215/224
D276,890 S 12/1984 Hancher ..... D9/376
4,491,234 A 1/1985 Wilcock ..... 220/90
4,520,936 A 6/1985 Lyons ..... 215/1 C
D279,763 S 7/1985 Hestehave et al. ..... D9/375
4,548,332 A 10/1985 Neat ..... 220/268
D281,579 S 12/1985 Drummond, Jr. et al. .... D9/376
4,583,666 A 4/1986 Buck ..... 222/109
4,619,373 A 10/1986 Galer ..... 220/354
D289,377 S 4/1987 Ashby et al. ..... D9/378
4,664,295 A 5/1987 Iida ..... 222/109
4,671,421 A 6/1987 Reiber et al. ..... 215/228
4,702,395 A 10/1987 Nitsch ..... 222/109
4,706,829 A 11/1987 Li ..... 215/354
4,736,874 A 4/1988 Durant ..... 222/570
D296,873 S 7/1988 Dent et al. ..... D9/401
4,771,501 A 9/1988 Leiter ..... 15/104.92
4,773,560 A 9/1988 Kittscher ..... 222/109
4,805,793 A 2/1989 Brandt et al. ..... 215/10
4,830,234 A 5/1989 Odet ..... 222/465.1
D304,014 S 10/1989 O'Connell ..... D9/372
D305,407 S 1/1990 Gonda ..... D9/376
4,893,723 A 1/1990 Seabolt ..... 220/85
4,911,319 A 3/1990 DeJean ..... 220/4 A
4,917,268 A 4/1990 Campbell et al. ..... 222/109
4,927,046 A 5/1990 Armstrong ..... 220/90
4,928,860 A 5/1990 Knight ..... 222/466
4,941,815 A 7/1990 Julian ..... 425/525
4,949,884 A 8/1990 Dahl ..... 222/570
4,974,749 A 12/1990 Mon ..... 222/111
D313,350 S 1/1991 Beaver ..... D9/376
4,984,714 A 1/1991 Sledge ..... 222/109
4,993,605 A 2/1991 Del'Re ..... 222/545
5,020,692 A 6/1991 Darr ..... 222/109
D318,228 S 7/1991 Schlesselman ..... D9/372
D320,345 S 10/1991 Hamly et al. ..... D9/372
5,054,661 A 10/1991 Hollje ..... 222/465.1
D321,624 S 11/1991 Fiore et al. ..... D7/321
5,064,101 A * 11/1991 Richter et al. ..... 222/143
D323,115 S 1/1992 Kelsey ..... D9/423
5,092,474 A 3/1992 Leigner ..... 215/1 C
5,108,009 A 4/1992 Davidson et al. ..... 222/109
5,119,972 A * 6/1992 Reed et al. ..... 222/143
D332,747 S 1/1993 Darr et al. ..... D9/520
5,188,249 A 2/1993 Cargile ..... 215/31
5,207,356 A 5/1993 Krall ..... 222/109
D336,434 S 6/1993 Binder ..... D9/528
D338,407 S 8/1993 Lynd ..... D9/531
5,234,130 A 8/1993 Benioff et al. ..... 222/111
5,269,438 A 12/1993 Kelsey ..... 220/766
5,299,710 A 4/1994 Welsch et al. ..... 220/675
5,322,662 A 6/1994 Benioff et al. ..... 264/533
D349,651 S 8/1994 Saffer ..... D9/528
D352,459 S 11/1994 Pollacco ..... D9/528
5,377,858 A 1/1995 Morris, Sr. ..... 220/254
D355,366 S 2/1995 Bainton ..... D9/532
5,390,805 A 2/1995 Bilani et al. ..... 215/260
D358,333 S 5/1995 Stockwell et al. ..... D9/531
5,431,306 A 7/1995 Reid ..... 222/111
D362,180 S 9/1995 Haines ..... D9/424
D370,153 S 5/1996 Chaney et al. ..... D7/511
D370,850 S 6/1996 Beaver ..... D9/543
D372,197 S 7/1996 Gough ..... D9/532
D374,178 S 10/1996 Valls et al. ..... D9/523
5,566,861 A 10/1996 Serano ..... 222/109
5,566,862 A 10/1996 Haffner et al. ..... 222/111
5,577,626 A 11/1996 Henkel et al. ..... 215/237
D376,761 S 12/1996 Lathrop et al. ..... D9/528
5,603,787 A 2/1997 Reid ..... 156/73.1
D379,302 S 5/1997 Rodman ..... D9/440
5,626,258 A 5/1997 Maiorino ..... 220/695
5,669,526 A 9/1997 Keyfauver ..... 220/696
5,678,684 A 10/1997 Wright ..... 206/204
D389,067 S 1/1998 Lown ..... D9/543
5,704,502 A 1/1998 Greenfield ..... 215/295
D392,188 S 3/1998 Darr et al. ..... D9/520
5,794,803 A 8/1998 Sprick ..... 215/217
5,823,345 A 10/1998 Nask et al. ..... 206/509
D401,154 S 11/1998 Robinson ..... D9/528
D403,243 S 12/1998 Takeuchi et al. ..... D9/532
5,850,953 A 12/1998 Dallas, Jr. ..... 222/571
5,855,299 A 1/1999 Arnold et al. ..... 222/109
5,855,304 A 1/1999 Dean et al. ..... 222/481
5,868,283 A 2/1999 Wilson et al. ..... 222/111
5,875,942 A 3/1999 Ohmi et al. ..... 222/556
5,893,489 A 4/1999 Giarrante ..... 222/482
5,896,993 A 4/1999 Nask et al. ..... 206/508
5,941,427 A 8/1999 Speer ..... 222/189.06
5,964,383 A 10/1999 Cargile ..... 222/571
5,975,346 A 11/1999 Imperato et al. ..... 220/831
6,029,858 A 2/2000 Srokose et al. ..... 222/143
D422,920 S 4/2000 Tapp et al. ..... D9/530
6,059,153 A 5/2000 Olson et al. ..... 222/465.1
6,068,161 A 5/2000 Soehnlen et al. ..... 222/143
6,085,949 A 7/2000 Zimny et al. ..... 222/572
D428,817 S 8/2000 Olson et al. ..... D9/531
6,123,231 A 9/2000 Geisinger ..... 222/109
6,209,762 B1 4/2001 Haffner et al. ..... 222/570
6,223,945 B1 5/2001 Giblin et al. ..... 222/109
D449,535 S 10/2001 Geisinger et al. ..... D9/525
6,412,661 B1 7/2002 Hannah, Sr. ..... 222/111
6,530,500 B2 3/2003 Bravo et al. ..... 222/143
2002/0195471 A1 12/2002 Nottingham et al. ..... 222/570
2003/0102339 A1 6/2003 Walsh et al. ..... 222/567
2003/0102340 A1 6/2003 Walsh et al. ..... 222/572
2004/0026450 A1 * 2/2004 Rohr et al. ..... 222/109

* cited by examiner

PLASTIC PAINT CONTAINER HAVING A CUBE-SHAPED BODY

CROSS-REFERENCE TO RELATED APPLICATION

This application claims the benefit of U.S. Provisional Application No. 60/394,095 filed Jul. 3, 2002, the entire disclosure of which is hereby incorporated by reference.

BACKGROUND OF THE INVENTION

The present invention relates to containers, more specifically to containers for holding viscous fluids, such as paint.

Conventionally, paint is packaged in a cylindrical metal container having an upper rim with an annular groove formed therein that frictionally receives an annular protrusion of a lid for closing the container. If the container is a one gallon container, the container is typically provided with a wire bail handle connected to mounting ears secured to a side wall of the container. While the foregoing construction of a conventional paint container has benefits, it has drawbacks as well. A screw driver must be used to pry the lid off the paint container. In addition, paint typically collects in the groove of the rim, which, when solidified, will cause difficulty in the re-application or removal of the lid at some later time. Also, small amounts of rust often form on the metal of the container and then fall into the paint in the container.

Efforts have been made to address some of the foregoing deficiencies in conventional metal paint containers. For the most part, these efforts have failed to comprehensively address the foregoing and other deficiencies of conventional paint containers. Recently, however, published U.S. patent application Ser. No. U.S 2001/0025865A1 to Bravo et al. (now U.S. Pat. No. 6,530,500) disclosed a square plastic paint container having an integral handle with a handle passage. The Bravo et al. container further includes a threaded lid, a bail handle and a raised pour spout. This construction provides numerous benefits over conventional paint containers. Some commercially available paint mixing machines, however, require a counterweight to be inserted into the handle passage of the Bravo et al. container to balance the container during mixing.

The present invention is directed to a square plastic paint container that is facile to handle, but does not require a handle passage extending therethrough. In this manner, the need for a counterweight is eliminated. Additionally, the external dimension of a container without an integral handle and handle passage can be less for the same internal volume than a container having such a handle and passage.

SUMMARY OF THE INVENTION

The present invention is directed to a container for holding paint. The container includes a body defining an interior volume and a top collar having a passage extending therethrough for providing access to the interior volume. The collar has an exterior thread. The body includes a plurality of side walls joined at rounded corners to provide the body with a substantially square cross-section. A first pair of the side walls is joined at a first one of the corners. A bottom wall of the body has a recess formed therein for receiving the finger or fingertips of a user. The recess extends diagonally between the first pair of side walls and is positioned toward the first one of the corners. A cap is provided for closing the passage through the collar. The cap has an interior thread for mating with the exterior thread of the collar to secure the cap to the collar. A bail handle structure is connected to the collar. The bail handle structure includes a bail handle having legs joined to an annular band disposed around the collar.

Also provided in accordance with the present invention is a paint container having a body defining an interior volume, wherein the body includes a plurality of side walls joined at rounded first, second, third and fourth corners to provide the body with a substantially square cross-section. The first and third corners are diagonally opposed to each other and the second and fourth corners are diagonally opposed to each other. The second and fourth corners have handle recesses formed therein, respectively. A top collar is joined to the body and has a passage extending therethrough for providing access to the interior volume of the body. The collar has an exterior thread. A pour spout is disposed within the collar. The pour spout is aligned with the first and third corners such that paint may be poured through the pour spout in the direction of the first and third corners. A cap is provided for closing the passage through the collar. The cap has an interior thread for mating with the exterior thread of the collar to secure the cap to the collar.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
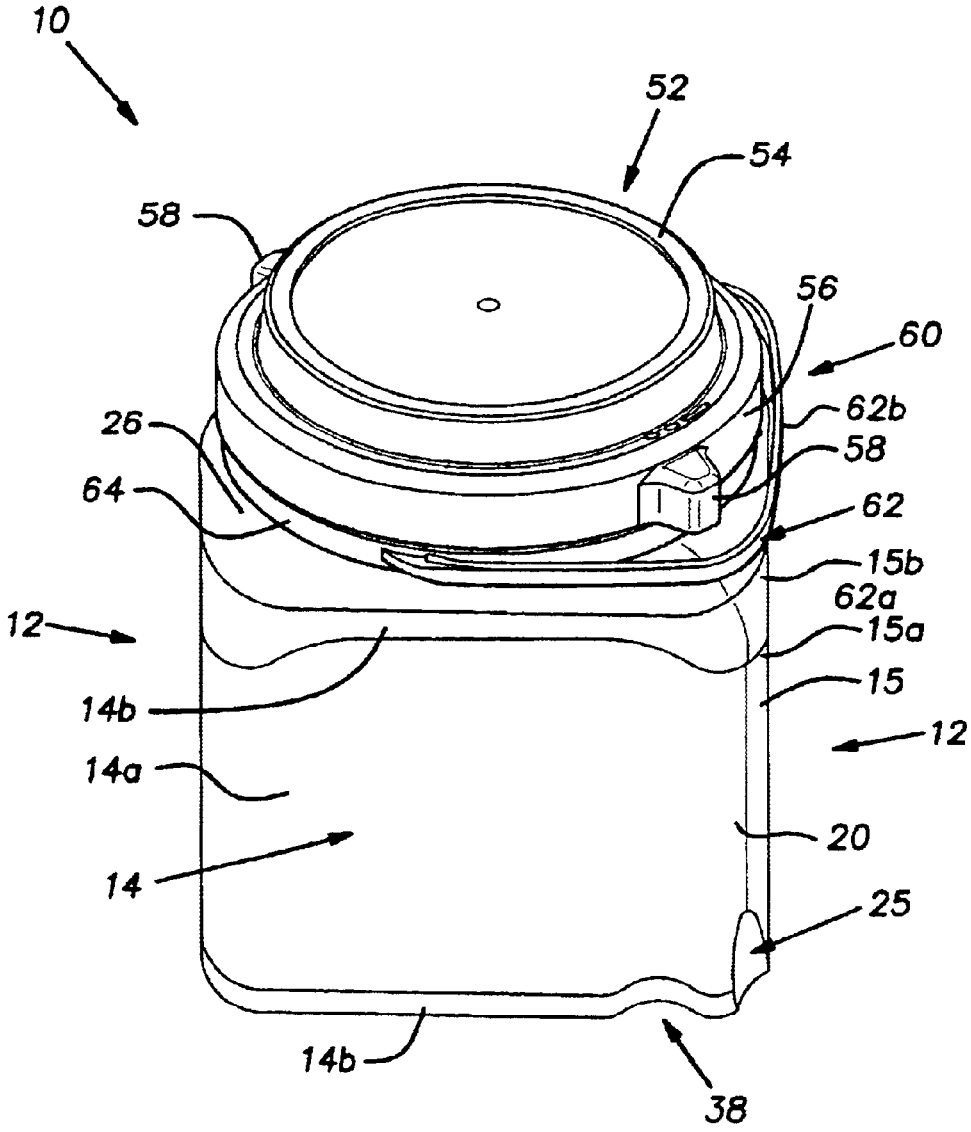
FIG. 1 shows a side perspective view of a square plastic paint container constructed in accordance with a first embodiment of the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional one gallon paint container" shall mean a cylindrical steel container for holding paint, having an interior volume of slightly greater than 1 gallon, a diameter of about 6⅝ inches and a height of about 7 11/16 inches, and including a bail handle secured to a pair of mounting ears.

Figure 2:
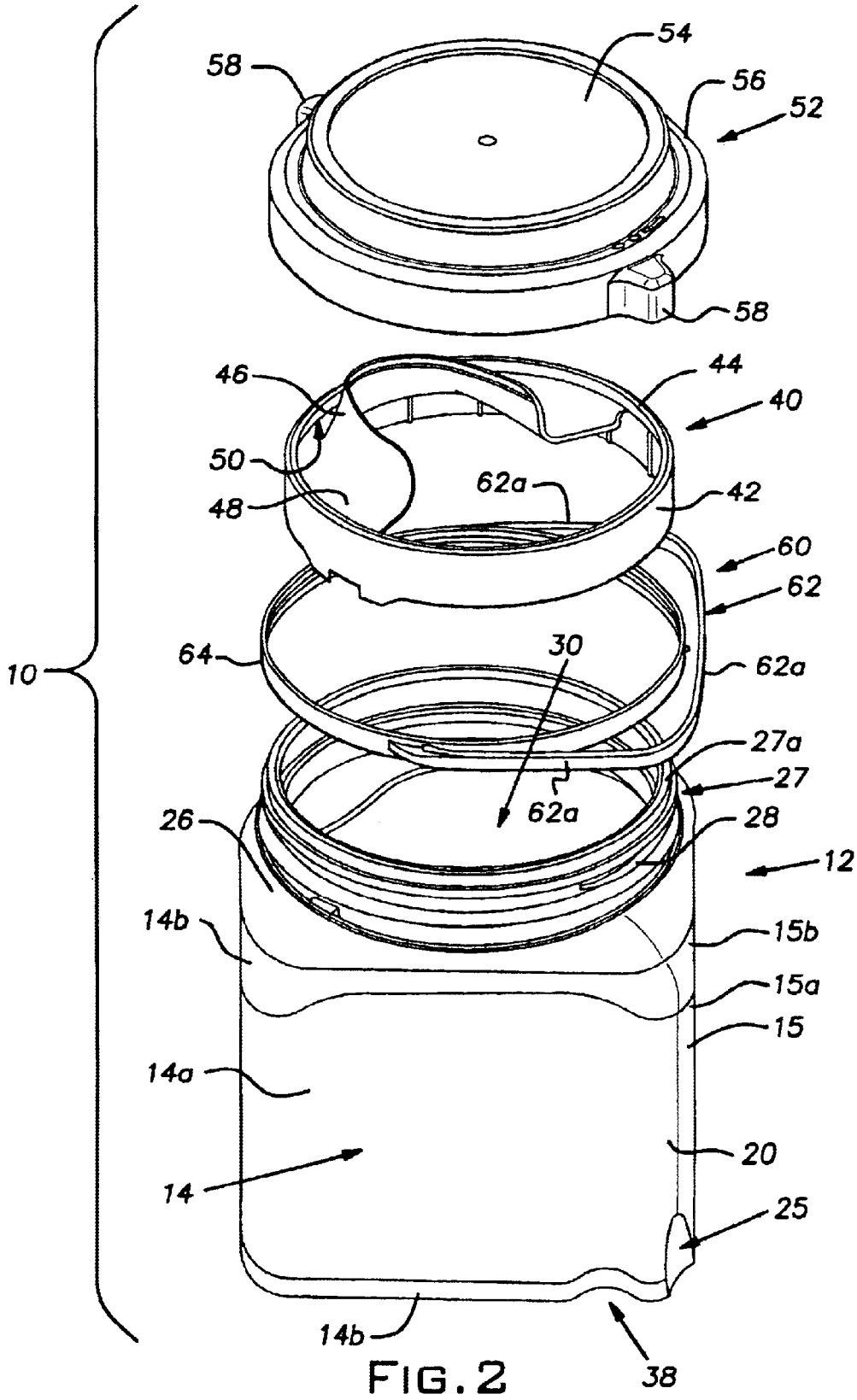
FIG. 2 shows an exploded view of the square plastic paint container of the first embodiment.
Figure 3:
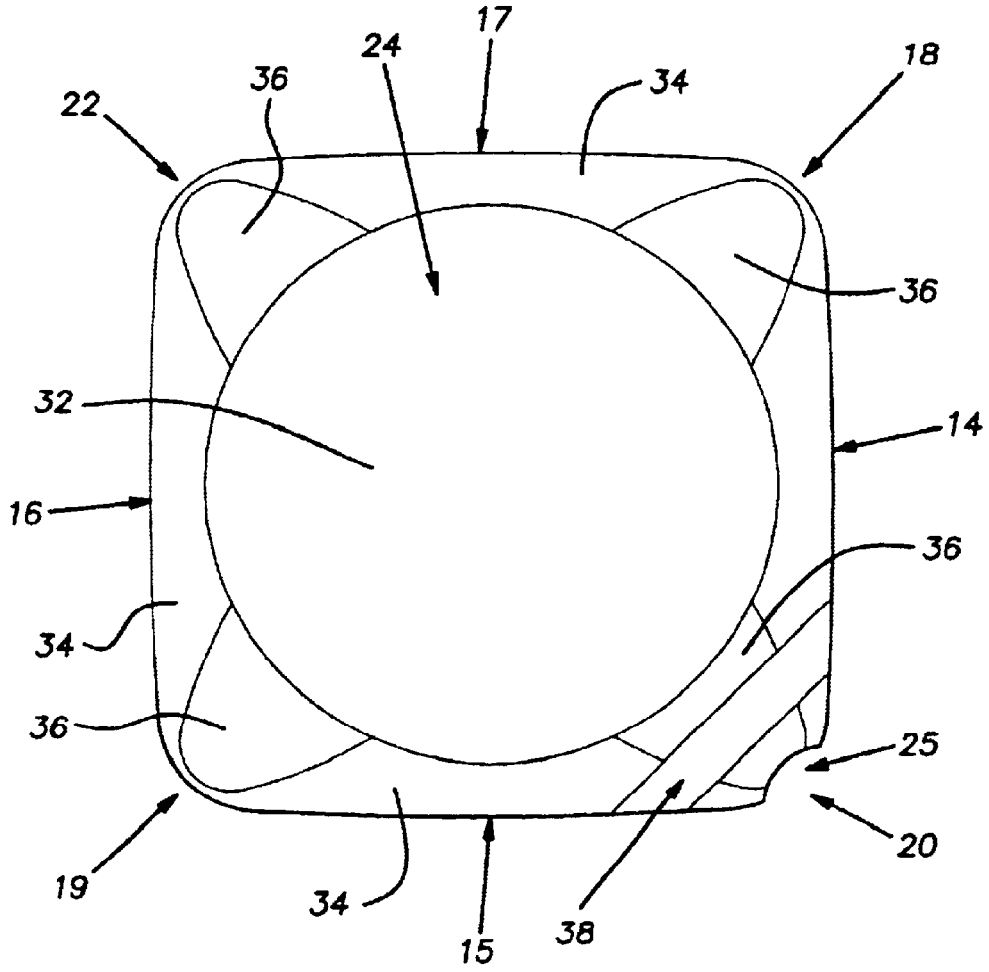
FIG. 3 shows a planar bottom view of the square plastic paint container of the first embodiment.

Referring now to FIGS. 1–3, there is shown a plastic paint container 10 constructed in accordance with a first embodiment of the present invention. The container 10 is preferably blow molded from high density polyethylene and comprises a cube-shaped plastic body 12 having generally square side walls 14, 15, 16 and 17. The side walls 14–17 have a thickness of about 0.06 inches. The side walls 14 and 17 are joined at a rounded side corner 18 and the side walls 15 and 16 are joined at a rounded side corner 19. The side walls 14 and 15 are joined at a rear corner 20 and side walls 16 and 17 are joined at a sloping front corner 22. The side walls 14–17 respectively have planar central portions 14*a*, 15*a*, 16*a*, 17*a* disposed between rounded peripheral edge portions 14*b*, 15*b*, 16*b*, 17*b*. Although not shown, label(s) are secured to one or more of the central portions 14*a*, 15*a*, 16*a*, 17*a*. The peripheral edge portions 14*b*,15*b*, 16*b*,17*b* are raised above the central portions 14*a*, 15*a*, 16*a*, 17*a* so as to protect the label(s).

The body 12 also includes a bottom wall 24 and a top wall 26 with an enlarged opening formed therein. The top wall 26 and the bottom wall 24 have a thickness of about 0.06 inches. A thumb recess 25 is formed in the rear corner 20 and extends upwardly from the bottom wall 24. The thumb recess 25 is sized to accommodate an adult human thumb and has a length of from about 1 to about 1.5 inches and a width of about 1 inch. The thumb recess 25 is recessed from the rear corner 20, preferably from about 1/32 of an inch to about 1/4 of an inch. As will be described more fully below, the thumb recess 25 is used in accordance with a method of the present invention for pouring of paint from the container 10.

A collar 27 with an external thread 28 is disposed around the opening in the top wall 26 and extends upwardly therefrom. The collar 27 terminates in an upper rim 27*a* and has a passage 30 extending therethrough to provide access to an interior volume of the body 12. The passage 30 has a cross-section sized to permit a conventional paint brush to extend therethrough. More specifically, the cross-section of the passage 30 preferably has a diameter greater than about 4 inches, more preferably greater than about 5 inches.

As shown in FIG. 3, the bottom wall 24 includes a generally frame-shaped peripheral portion 34 disposed around a circular central portion 32. The central portion 32 is recessed from the peripheral portion 34 and is sized to receive a top portion 54 of a lid 52 of the container 10 so as to facilitate stacking of a plurality of the containers 10. Four slight corner indentations 36 are formed in the peripheral portion 34, proximate to the side corners 18, 19 and the rear and front corners 20, 22 respectively. The corner indentations 36 help strengthen the bottom wall 24 and make the container 10 more stable when filled with paint. A finger recess 38 is formed in the bottom wall 24 and extends diagonally between the side walls 14, 15. The finger recess 38 is located toward the rear corner 20 and is recessed from both the central and peripheral portions 32, 34. As will be described more fully below, the finger recess 38 is used in accordance with the method of the present invention to facilitate the pouring of paint from the container 10.

A pouring insert 40 is provided for removable mounting in the passage 30 of the container 10. The pouring insert 40 comprises an annular mounting ring 42 having a skirt 44 for disposal over the upper rim 27*a* of the container 10. An arcuate pour spout 46 is disposed radially inward from the mounting ring 42 and is joined thereto by a curved wall 48. The pour spout 46 is generally semi-elliptical and extends above the upper rim 27*a* The apex of the pour spout 46 is aligned with the front corner 22 of the container 10 and is spaced about ½ an inch from the upper rim 27*a* when the pouring insert 40 is properly disposed in the access opening 26*a*. The curved wall 48 slopes downwardly as it extends rearwardly, toward the rear corner 20. The curved wall 48, the mounting ring 42 and the pour spout 46 define a drainage groove 50 that collects paint drips from the pour spout 46 and permits the collected paint to flow back into the container 10.

Figure 5:
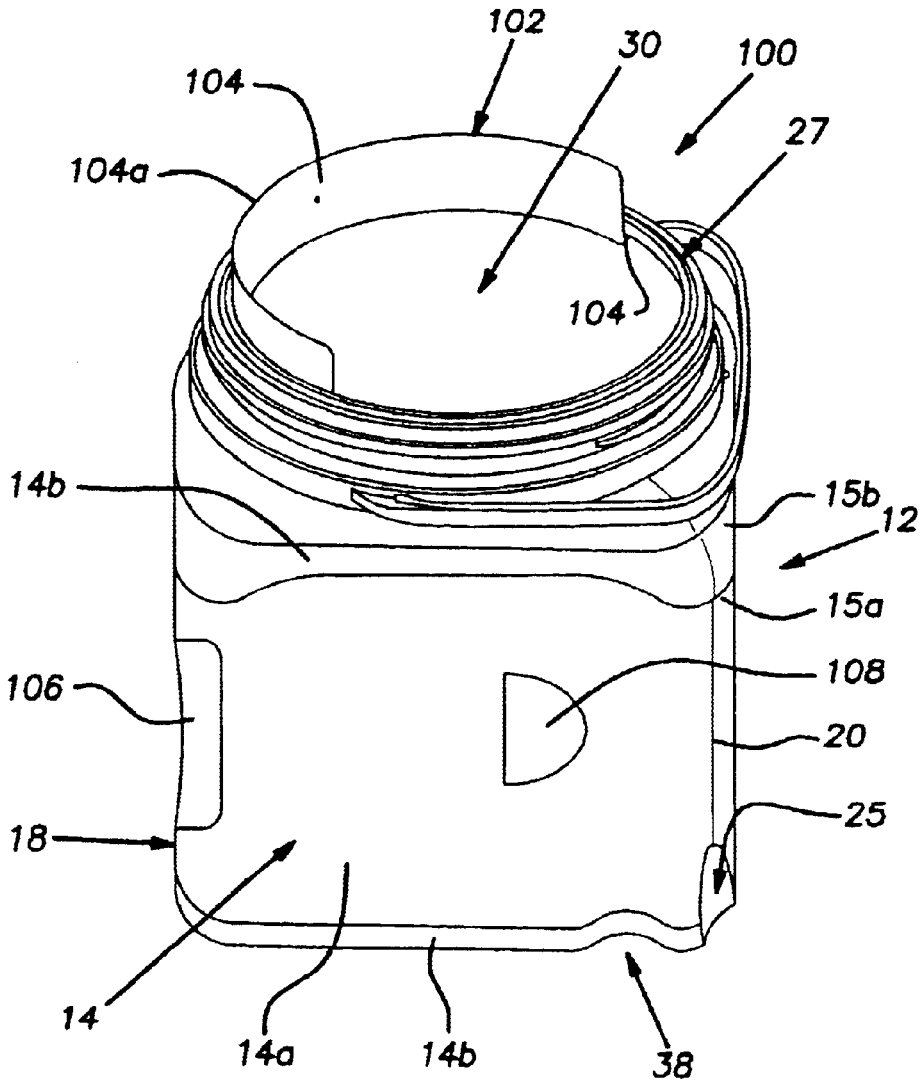
FIG. 5 shows a side perspective view of a square plastic paint container constructed in accordance with a second embodiment of the present invention.

It should be appreciated that in lieu of the removable pouring insert 40, the container 10 may be blow molded with an integral pouring structure, such as the container 100 shown in FIG. 5, which is constructed in accordance with a second embodiment of the present invention.

The lid 52 is tiered and comprises the cylindrical top portion 54, which is joined to a larger cylindrical bottom portion 56. The bottom portion 56 has an internal thread (not shown) for engaging the threads 28 of the collar 27 to threadably secure the lid 52 to the collar 27. A pair of grip tabs 58 extend radially outward from an outside surface of the bottom portion 56.

In one embodiment, the width of the container 10 is substantially the same as the diameter of a conventional cylindrical one gallon paint container, namely about 6⅝ inches. The height of the container 10, up to the top of the lid 52 (when it is securely threaded to the collar 27) is about 7⅞ inches. The interior volume of the container 10 is slightly greater than 1 gallon.

The container 10 includes a bail handle structure 60 composed of plastic and comprising a bail handle 62 integrally joined at opposing ends to an annular band 64. The handle 62 is generally rectangular and has two legs 62*a* joined to opposing ends of a central member 62*b* so as to be generally perpendicular thereto. Preferably, the band 64 is constructed to be expandable so that the band 64 can be snapped over the collar 27 and trapped under a lowermost turn of the threads 28. The band 64 can be rotated around the collar 27 between a flush position, wherein the legs 62*a* and central member 62*b* are substantially parallel to and flush with the side walls 14–17 of the body 12, and an extended position, wherein the legs 62*a* and the central member 62*b* are disposed at oblique angles to the side walls 14–17, thereby forming protruding loops. The bail handle 62 can be flexed to a carrying position, wherein the handle 62 is substantially perpendicular to the band 64.

Figure 4:
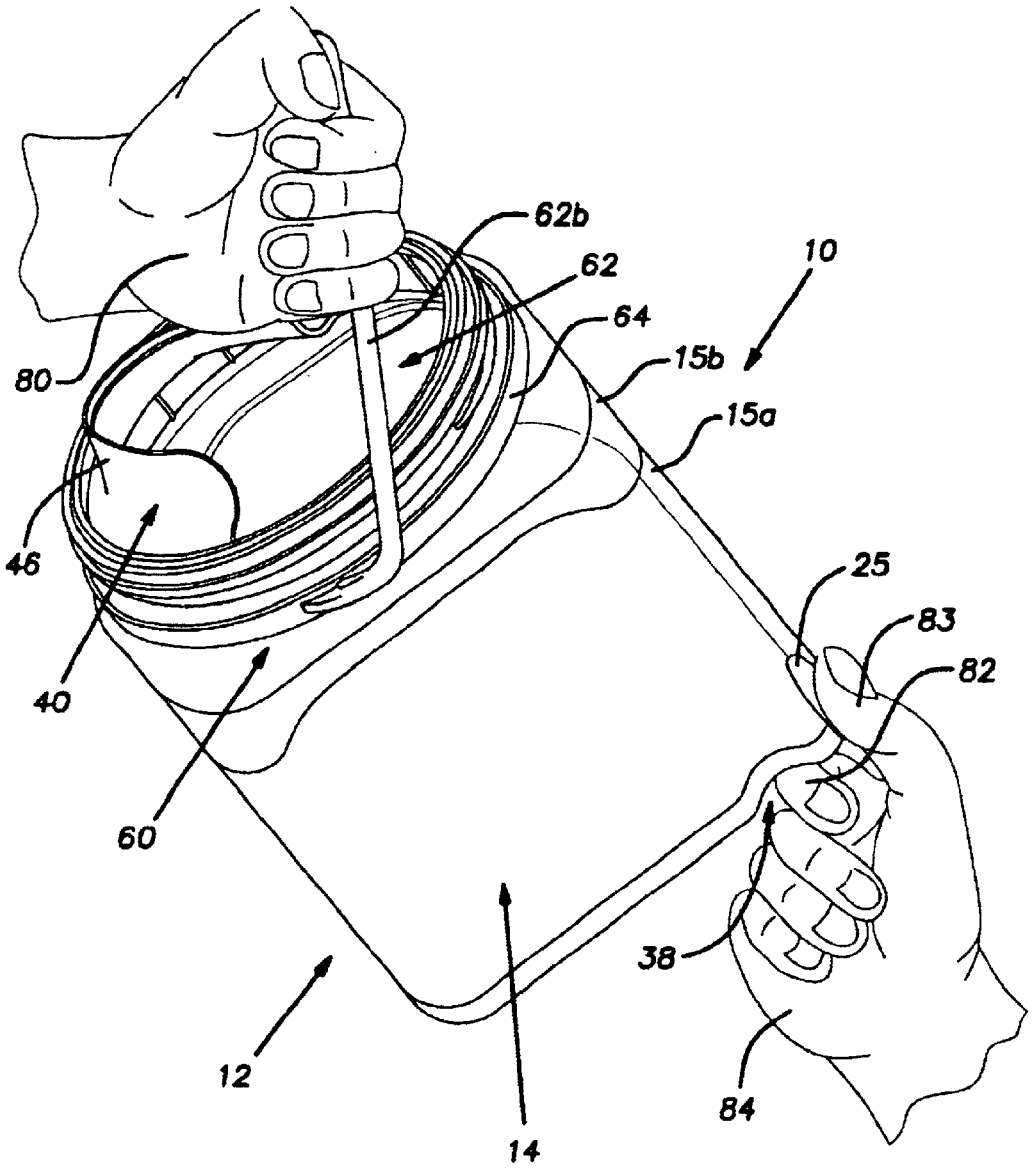
FIG. 4 shows the square plastic paint container of the first embodiment being held in a pouring position.

The construction of the container 10 facilitates the pouring of paint from the container 10 by a user. In accordance with a method of the present invention, the user grasps the bail handle 62 of the container 10 with his/her hand 80, as shown in FIG. 4. The user supports the weight of the container 10 with his/her hand 80 through the bail handle structure 60. The user then disposes the index finger 82 of his/her other hand 84 in the finger recess 38 and positions the thumb 83 of his/her hand 84 in the thumb recess 25. While maintaining the position of his/her hand 80, the user moves his/her other hand 84 upwardly so as to cause the front corner 22 of the container 10 to pivot downwardly, thereby causing paint to flow out of the pour spout 46 and into another receptacle, such as a paint tray. Alternatively, rather than using an index finger, the user can insert the fingertips of one hand 84 into the finger recess 38 and move that hand upward so as to cause the front corner 22 to pivot downwardly.

Referring now to FIG. 5, there is shown a container 100 constructed in accordance with a second embodiment of the present invention. The container has the same construction as the container 10, except for the differences recited below.

Instead of having the pouring insert 40, the container 100 is blow molded so as to have an integral pouring structure 102. The pouring structure 102 includes a drip catch 104 joined to the collar 27. The drip catch 104 extends into a semi-circular pour spout 104, which extends above the collar 27 about one half of an inch and tapers to a thin upper edge 104*a*.

Figure 6:
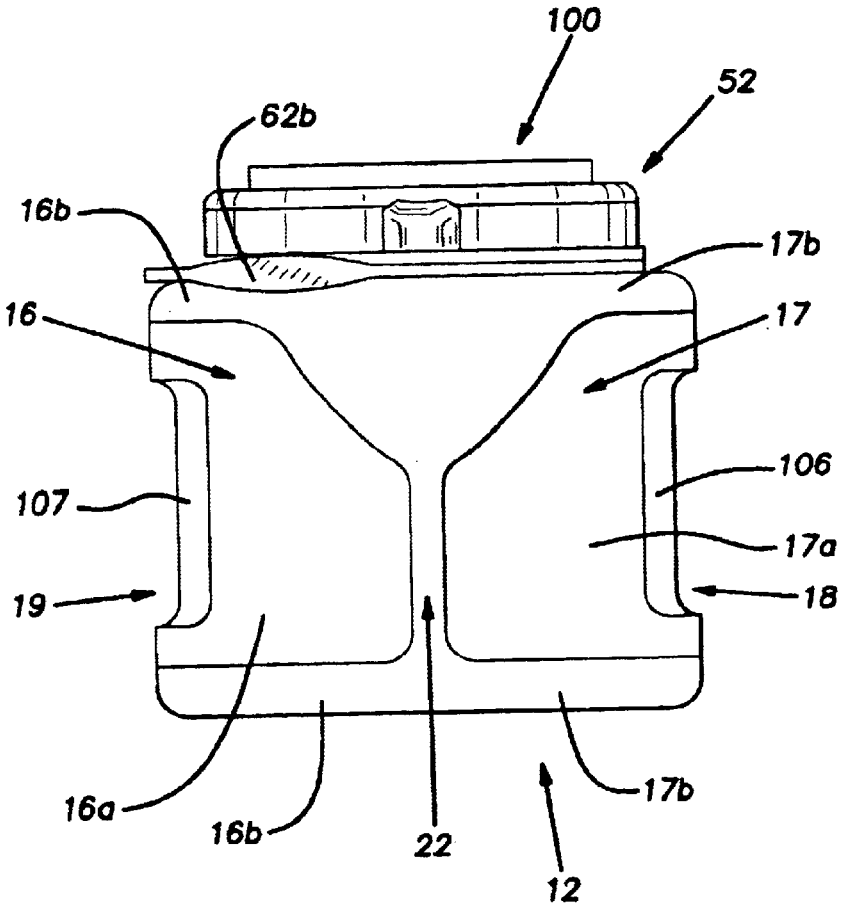
FIG. 6 shows a front view of the square plastic paint container of the second embodiment.

Referring now also to FIG. 6, a pair of hand grips 106, 107 are formed in the body 12 at the side corners 18, 19, respectively. The hand grip 106 curves around the side corner 18 and extends into the central portions 14*a*, 17*a* of the side walls 14 and 17.

Similarly, hand grip 107 extends around side corner 19 and extends into the central portions 15*a*, 16*a* of the side walls 15 and 16. The hand grips 106, 107 are recessed from both the side corners 18, 19 and the central portions 14*a*–17*a* of the side walls 14–17. Preferably, the hand grips 106, 107 are recessed from the central portions 14*a*–17*a* from about 1/32 of an inch to about 1/4 of an inch. The vertical length of each of the hand grips 106, 107 is sized to accommodate the width of four fingers of an adult hand placed together, which is about 3½ inches. As will be described more fully below, the hand grips 106, 107 are used in accordance with a method of the present invention for pouring paint from the container 100.

A pair of thumb indents 108 are formed in the side walls 14,15, respectively. The thumb indents 108 are preferably semi-elliptical in shape and are positioned midway along the height of the side walls 14 and 15, toward the rear corner 20. Each of the thumb indents 108 is sized to accommodate an adult human thumb and has a width of from about 1 to about 1½ inches and a height of about 1 inch. The thumb indents 108 are recessed from the central portions 14*a*, 15*a* of the side walls 14,15, preferably from about 1/32 of an inch to about 1/4 of an inch. As will be described more fully below, the thumb indents 108 are used in accordance with a method of the present invention to facilitate the pouring of paint from the container 100.

Figure 7:
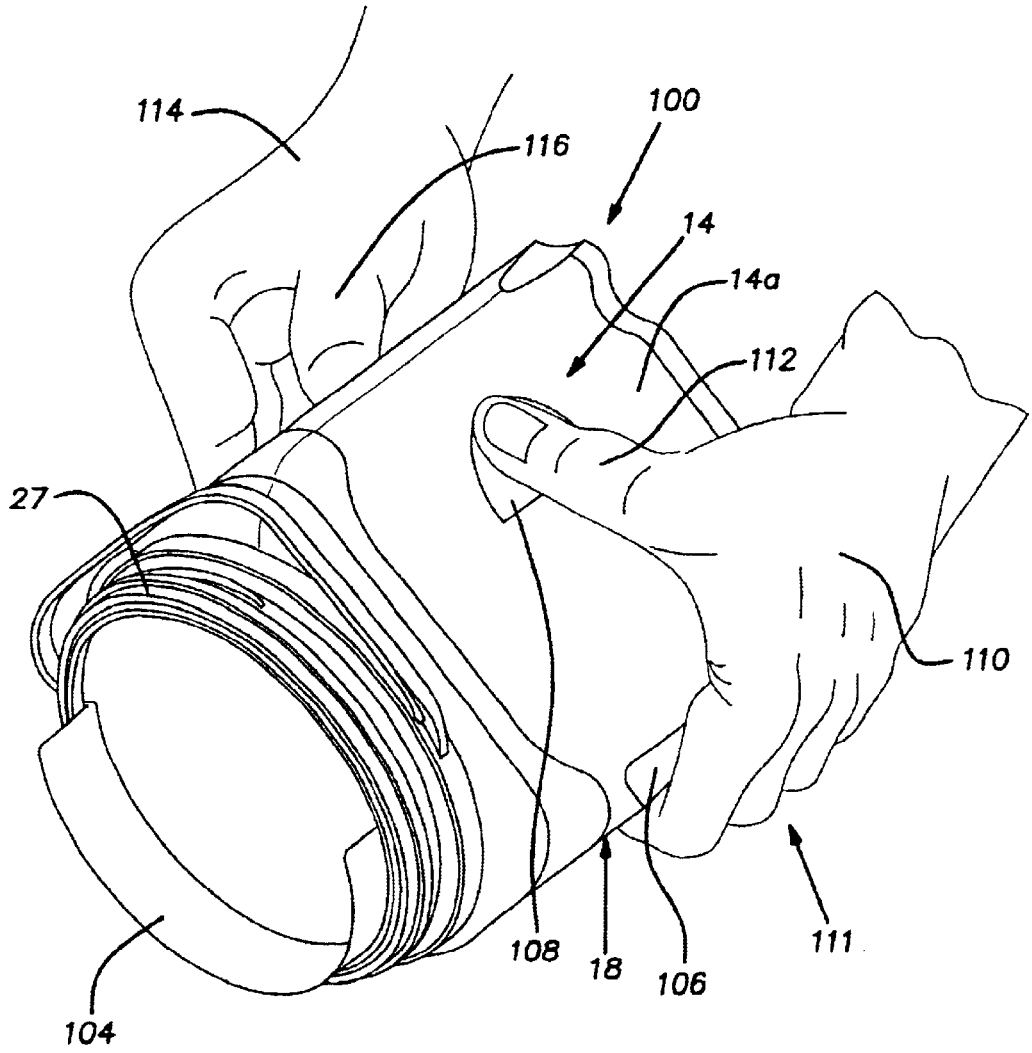
FIG. 7 shows the square plastic paint container of the second embodiment being held in a pouring position.

The construction of the container 100 facilitates the pouring of paint from the container 100 by a user. In accordance with a method of the present invention, the user places the fingers 111 of his/her hand 110 in the hand grip 106, with the knuckle joints disposed over the side corner 18, and disposes the thumb 112 of his/her hand 110 in the thumb indent 108, all as shown in FIG. 7. Similarly, the user places the fingers of his/her other hand 114 in the hand grip 107, with the knuckle joints disposed over the side corner 19, and disposes the thumb 116 of his/her hand 114 in the thumb indent 108 of the side wall 15. The user then pivots the wrists of his/her hands 110, 114 downwardly so as to pivot the front corner 22 of the container 100 downwardly, thereby causing paint to flow out of the pour spout 104 and into another receptacle, such as a paint tray.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A container for holding paint, said container comprising:

(a) a body defining an interior volume, said body comprising:

a plurality of side walls joined at rounded corners to provide said body with a substantially square cross-section, a first pair of said side walls being joined at a first one of the corners;

a bottom wall having a recess formed therein for receiving the finger of a user, said recess extending diagonally between the first pair of side walls and being positioned toward the first one of the corners;

(b) a top collar joined to the body and having a passage extending therethrough for providing access to said interior volume of the body, said collar having an exterior thread;

(c) a cap for closing the passage through the collar, said cap having an interior thread for mating with the exterior thread of the collar to secure the cap to the collar; and (d) a bail handle structure connected to the container.

2. The container of claim 1 wherein the bail handle structure is connected to the collar.

3. The container of claim 2, wherein the bail handle structure comprises a bail handle having legs joined to an annular band disposed around the collar.

4. The container of claim 1, wherein a recess is formed in the first one of the corners to receive a thumb of a user.

5. The container of claim 4, wherein the container further comprises a pour spout disposed within the collar.

6. The container of claim 5, wherein the pour spout extends above the collar.

7. The container of claim 6, wherein the apex of the pour spout is aligned with a second one of the corners, said second one of the corners being diagonally disposed opposite the first one of the corners.

8. The container of claim 6, wherein the body is composed of plastic.

9. The container of claim 1, wherein the cross-section of the passage extending through the collar has a diameter of at least about four inches.

10. The container of claim 9 wherein the cross-section of the passage has a diameter of at least about 5 inches.

11. The container of claim 1, wherein the container further comprises a pouring spout insert disposed within the collar, said insert comprising a pouring spout and a paint return groove.

12. The container of claim 11, wherein the pouring insert is removably affixed to the container.

13. The container of claim 1, wherein the container further comprises an integral pouring structure.

14. The container of claim 6, wherein the cap has an interior height sufficient to accommodate the pour spout when the cap is secured to the collar.

15. A container for holding paint, said container comprising:

(a) a body defining an interior volume, said body comprising:

a plurality of side walls joined at rounded first, second, third and fourth corners to provide the body with a substantially square cross-section, said first and third corners being diagonally opposed to each other and said second and fourth corners being diagonally opposed to each other, said second and fourth corners having handle recesses formed therein, respectively;

(b) a top collar joined to the body and having a passage extending therethrough for providing access to the interior volume of the body, said collar having an exterior thread;

(c) a pouring insert including a pour spout disposed within the collar, said pour spout being aligned with the first and third corners such that paint may be poured through the pour spout in the direction of the first and third corners; and (d) a cap for closing the passage through the collar, said cap having an interior thread for mating with the exterior thread of the collar to secure the cap to the collar.

16. The container of claim 15, wherein the handle recesses extend into each of the side walls forming the second and fourth corners.

17. The container of claim 15, wherein the side walls forming the first corner has a pair of thumb recesses formed therein, respectively.

18. The container of claim 15, wherein the thumb recesses are disposed toward the first corner.

19. The container of claim 18, wherein the pour spout is disposed toward the third corner.

20. The container of claim 15, wherein the body, the top collar and the pour spout are composed of plastic and are formed together through blow molding.

21. The container of claim 15, wherein the pouring insert is removably affixed to the container.

22. The container of claim 15, wherein the pour spout is disposed inwardly from the collar so as to define a paint return groove between said spout and said collar.

23. The container of claim 15, wherein the pour spout extends above the collar.

24. The container of claim 23, wherein the cap has an interior height sufficient to accommodate the pour spout when the cap is secured to the collar.

* * * * *

UNITED STATES PATENT AND TRADEMARK OFFICE

CERTIFICATE OF CORRECTION

PATENT NO. : 6,896,156 B2
APPLICATION NO. : 10/612570
DATED : May 24, 2005
INVENTOR(S) : Robert E. McDonald et al.

It is certified that error appears in the above-identified patent and that said Letters Patent is hereby corrected as shown below:

In the Drawings,

Sheet 1, Fig. 1, the reference numeral "62a" should applied to the leg element attached to the central member 62b.

Sheet 2, Fig. 2, the reference numeral "62a" (first appearance from the top) should read "62b" to identify the central member.

Signed and Sealed this
Second Day of June, 2015

Michelle K. Lee

Michelle K. Lee
*Director of the United States Patent and Trademark Office*